US009951557B2

(12) United States Patent
Roseveare, Jr. et al.

(10) Patent No.: US 9,951,557 B2
(45) Date of Patent: Apr. 24, 2018

(54) ROOFING LADDER BRACKET AND SAFETY EQUIPMENT

(71) Applicants: Ronald Newman Roseveare, Jr., Lynchburg, VA (US); Bryan Douglas Relyea, Lynchburg, VA (US); Nicholas Mark Liberto, Lynchburg, VA (US)

(72) Inventors: Ronald Newman Roseveare, Jr., Lynchburg, VA (US); Bryan Douglas Relyea, Lynchburg, VA (US); Nicholas Mark Liberto, Lynchburg, VA (US)

(73) Assignee: SLATOR, LLC, Lynchburg, VA (US)

( * ) Notice: Subject to any disclaimer, the term of this patent is extended or adjusted under 35 U.S.C. 154(b) by 0 days.

(21) Appl. No.: 14/866,413

(22) Filed: Sep. 25, 2015

(65) Prior Publication Data

US 2016/0130876 A1 May 12, 2016

Related U.S. Application Data

(60) Provisional application No. 62/075,982, filed on Nov. 6, 2014.

(51) Int. Cl.

| | |
|---|---|
| ***E06C 9/00*** | (2006.01) |
| ***E04G 3/00*** | (2006.01) |
| ***E06C 7/48*** | (2006.01) |
| ***E06C 1/34*** | (2006.01) |
| ***E06C 7/50*** | (2006.01) |
| *E06C 7/14* | (2006.01) |
| *E04G 3/26* | (2006.01) |
| *E06C 7/18* | (2006.01) |

(52) U.S. Cl.

CPC ..... *E06C 7/488* (2013.01); *E06C 1/345* (2013.01); *E06C 7/50* (2013.01); *E04G 3/26* (2013.01); *E06C 7/14* (2013.01); *E06C 7/18* (2013.01); *E06C 7/48* (2013.01)

(58) Field of Classification Search

CPC ... E06C 1/34; E06C 1/36; E06C 1/345; E06C 9/00; E06C 9/06; E06C 9/02

USPC ..... 248/546, 547, 210, 211, 238, 247, 248, 248/300, 316.4, 237, 229.1, 229.15, 248/226.11, 227.4, 228.6, 231.71

See application file for complete search history.

(56) References Cited

U.S. PATENT DOCUMENTS

| | | | | | |
|---|---|---|---|---|---|
| 893,123 | A * | 7/1908 | Appleton | E04G 3/26 | 248/237 |
| 1,018,877 | A | 2/1912 | Chickering | | |
| 1,252,224 | A * | 1/1918 | Bittner | H02G 3/125 | 182/206 |
| 1,393,048 | A * | 10/1921 | Stiles | E06C 1/345 | 182/206 |
| 1,470,489 | A * | 10/1923 | Schuh | E06C 1/345 | 182/206 |
| 2,316,723 | A * | 4/1943 | Sorenson | E06C 1/345 | 182/206 |
| 2,448,716 | A * | 9/1948 | Hurd | E06C 1/345 | 182/206 |

(Continued)

*Primary Examiner* — Terrell McKinnon
*Assistant Examiner* — Michael McDuffie

(57) ABSTRACT

A roofing ladder bracket and safety assembly adapted to be secured to a roof of a building comprising a base member and a clamping member configured as a ladder clamping mechanism for firmly securing a ladder to a roof of a building and including a safety mechanism to which a worker's safety equipment or a worker's tethered tool can be attached.

28 Claims, 9 Drawing Sheets

(56) References Cited

U.S. PATENT DOCUMENTS

| | | | | | |
|---|---|---|---|---|---|
| 3,606,226 | A * | 9/1971 | Bell | E06C 1/345 | 182/206 |
| 4,678,061 | A * | 7/1987 | Jordan | E06C 1/345 | 182/107 |
| 4,695,023 | A * | 9/1987 | McCafferty | E06C 1/345 | 182/121 |
| 5,896,719 | A | 4/1999 | Thornton | | |
| 5,975,239 | A * | 11/1999 | Castaneda | E04G 21/3261 | 182/45 |
| 6,045,102 | A | 4/2000 | Terenzoni | | |
| 6,158,549 | A * | 12/2000 | Hartman, Jr. | E06C 7/48 | 182/206 |
| 6,550,577 | B1 * | 4/2003 | Allgire | E06C 7/486 | 182/107 |
| D629,679 | S | 12/2010 | Riddell et al. | | |
| 8,756,870 | B2 | 6/2014 | Teller et al. | | |
| 8,844,887 | B2 * | 9/2014 | Genschorek | B30B 3/04 | 182/117 |
| 9,194,129 | B2 * | 11/2015 | O'Donnell | E04G 5/041 | |
| 2002/0195532 | A1 * | 12/2002 | Macri | E04G 3/26 | 248/237 |
| 2004/0135037 | A1 | 7/2004 | Poldman | | |
| 2005/0167201 | A1 | 8/2005 | Young, Jr. et al. | | |
| 2007/0278037 | A1 | 12/2007 | Michel et al. | | |
| 2008/0302934 | A1 | 12/2008 | Nelson et al. | | |
| 2012/0067667 | A1 * | 3/2012 | Marcoux | A62B 35/0068 | 182/3 |
| 2012/0080263 | A1 | 4/2012 | Lee | | |
| 2013/0206940 | A1 * | 8/2013 | Hopkins | E04G 21/328 | 248/237 |
| 2015/0354279 | A1 * | 12/2015 | Colon | E06C 7/14 | 248/210 |

* cited by examiner

ROOFING LADDER BRACKET AND SAFETY EQUIPMENT

CROSS-REFERENCE TO RELATED APPLICATIONS

Not applicable.

STATEMENT REGARDING FEDERALLY SPONSORED RESEARCH OF DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

FIELD

This document generally relates to the field of roofing and devices used therein for stabilizing roofing ladders on roof surfaces and additionally, includes a safety mechanism for workers in case of slipping or falling as well as anchors for holding tools.

BACKGROUND OF THE INVENTION

Asphalt roof shingles currently represent 80% of the residential roof market in the United States today. They vary in style, colors, and sizes and will continue to do so. They have a limited lifespan and are designed to be replaced multiple times during the life of the structure or home they are protecting. They are easily damaged by falling branches, hail, and often by homeowners, painters, satellite dish installers, chimney workers, and even roofers. Sometimes, the damage, in the form of holes, tears or punctures, are intentionally done by these contractors while installing communication equipment such as antennas and satellite dishes, roof jacks, ladder support brackets and roof safety equipment. Examples of such ladder support brackets and safety equipment are disclosed in U.S. Patent application No. 2004/0135037 A1, U.S. Patent Application No. 2007/0278037 A1 and U.S. Pat. No. 5,896,719. The installation of these devices often requires the installer to drill or puncture holes through the asphalt shingles to drive anchors into the rafters or wood sheathing beneath the shingle layers in order to secure the ladder support brackets or safety equipment to the roof. These anchors may include large common nails or screws. After the roofing job is completed and the ladder support brackets, roof jacks and safety equipment are removed, any holes, tears, or punctures must be repaired to prevent water leaks through the shingles and into the interior of the building. Regardless of how the shingles are damaged, current methods of repairing such holes, tears, or punctures simply include coating and/or filling the holes or punctures with conventional roofing cement or sealant. Although such methods have proven to be satisfactory in the short term, they are costly, time consuming, messy, unattractive and distracting from the original beauty of the shingle. If done improperly the entire hole, tear or puncture may not be completely filled and sealed and the leak will continue. And even when done properly, these methods generally fail within 7 years due to exposure to sunlight and the cyclic hot and cold temperatures which crack or dislodge this type of repair. This becomes a repeating nuisance, leak and expense for the homeowner who might have 30 years of life remaining for their shingles. If the damage is too extensive, the shingles may need to be replaced entirely, which may lead into other problems such as matching the shingles with currently available shingles or finding an available experienced repair person. Such methods require other tools such as an injecting/caulking gun and tube of sealant, or a spatula for spreading the cement or sealant from a pale of cement.

As a solution to this problem, an asphalt shingle sealing device as disclosed in copending patent application Ser. No. 14/808,195 eliminates any of the drawbacks of the current repairing methods discussed supra. The asphalt shingle sealing device relates generally to an asphalt roof shingle sealing device comprised of a single flat blank sheet of metal or rigid plastic. The asphalt shingle sealing device includes a simple, non-messy, quick and easy-to-use asphalt shingle sealing device that eliminates the need to inject or coat roofing cement or sealant into the holes, tears or punctures as employed in the current methods.

In performing roofing jobs such as those described supra, other dangers exist. According to OSHA, falls in the workplace are the leading cause of injury and death. In 2013, 294 deaths occurred by falls in construction and lack of proper fall protection in construction was number one in citations.

OSHA requires the use of Personal Protective Equipment (PPE) while working at heights that put someone at risk of falling more than 6 feet. Working on roofs is very dangerous and ridge anchor points for fall protection devices are a critical component of the PPE system. OSHA does not, however, tell workers "how" they can safely reach the ridge of a roof to install a proper anchor (because that's been a real problem up until the bracket of the present invention was invented). OSHA acknowledges this difficulty by allowing roof inspectors to climb about on roofs, unprotected by fall protection equipment as long as anchors or proper fall protection equipment is installed prior to "work" actually beginning. The installer of the first anchor point has also been waived from this requirement.

Thus, the question remains: How can workers get to the ridge of a roof safely so they can install a first safety ridge anchor or another first safety anchor device? Thus, there is a need in the industry to address this problem.

The present invention, as described in detail hereinafter, provides a solution to the problem by including a bracket having a ladder clamping mechanism and safety mechanism to which a worker's safety equipment can be attached. The bracket of the present invention may be installed easily and quickly on asphalt, cedar shake or slate roofs by a competent person. The present invention may also be adaptable to metal roofs by using a conversion bracket as discussed hereinafter. Depending on the extent of the roof, several brackets of the present invention may need to be installed on the roof. A first bracket is installed on the roof near a peripheral eve thereof by a worker standing on a ladder leaning against the edge of the roof. After the first bracket is mounted to the roof, another ladder is then raised onto the roof and inserted into the bracket and clamped in place. The worker can then attach his/her safety equipment to the bracket or ladder and safely mount the ladder lying on the roof. As the worker climbs the ladder, other brackets may be installed on the roof for further securement of the ladder holding the worker for another ladder. These other ladders may be installed in line with the previous ladder, or may be installed in side-by-side relation. Depending on the extent of the roof, the worker could then install other brackets for holding ladders or providing additional anchor points for fall protection as necessary until the ridge is reached.

BRIEF SUMMARY OF THE INVENTION

The present invention, as described in detail hereinafter, provides a solution to the problem by including a bracket having each part made of a rigid and suitable material that meets the required strength to hold the ladder, a worker, and the impact load of a vertical fall of six feet by the worker as required to be OSHA compliant. The bracket could be made from sheet metals such as mild steel, stainless steel, or aluminum. The sheet metal preferably is in the range of 10-12 gauge. The bracket could be made from moldable metals by injection or pour molding processes. Other moldable materials such as strong polymers or carbon fiber materials could also be employed from which the bracket is molded. The present invention is not to be limited by the materials selected in its manufacture as long as they meet OSHA requirements. The bracket includes a ladder rung clamping mechanism for securing a ladder to the roof of a building and safety mechanism to which a worker's safety equipment can be attached.

The bracket of the present invention includes a flat base member having a bottom surface adapted to overly the roof and a top surface. The base member having an upper end adapted to be mounted facing the ridge of the roof and a lower end with a first part of the clamping mechanism extending from the lower end of the base member and adapted to secure the rung of a ladder therein. The upper end includes a width and a length with at least one hole and/or side slot therein for receiving anchors such as 20 penny nails, lag bolts or ledger lock bolts that are driven or screwed through the asphalt shingle, slate, or cedar shake and into roofing substrate and roof rafter to secure the base member to the roof. The lower end of the base member includes a width and a length and a series of centrally located holes therethrough that are either threaded or not threaded for receiving anchor bolts therethrough from the bottom surface of the base member. Such anchor bolts are recessed into the bottom surface of the base member so as to be flush with the bottom surface and thereby prevent any damage to the underlying shingles. The first part of the clamping mechanism comprises an extension of the base member that is configured as a J-shaped cross-section to act as a hook in which the rung of a ladder is nested.

In a first embodiment, the J-shaped cross-section of the first part of the clamping mechanism extends across the entire width of the lower end of the base member. The J-shaped cross-section is formed by a first bend extending a first portion of the base member extension approximately 90 degrees with respect to the plane of the remaining base member and a second bend extending a second portion of the base member extension in the same direction as the first portion at an obtuse angle of approximately 55 degrees with respect to the plane of the first portion or 145 degrees with respect to the plane of the remaining base member. The second bend is spaced from the first bend a distance Z, Z' to surround a ladder rung or approximately 2-3 inches. The first embodiment also includes a flat elongated spacer bar having a bottom surface adapted to overly the top surface of the base member and a top surface. The spacer bar includes an upper end and a lower end. The lower end of the spacer bar is configured as a safety attachment member. The spacer bar member preferably has a width and length less than the width and length of the base member and is adapted to overly the base member along the central axis thereof. However, the dimensions of the spacer bar is not intended to be limiting and can vary. The safety attachment member is angled upward from the plane of the flat spacer bar at approximately 30 degrees and includes a hole for receiving an attachment of a safety gear and/or tethered tool of a worker. The first portion of the J-shaped cross-section includes a central opening through which the safety attachment member extends. The spacer bar also includes stop elements extending laterally from the lower end and adapted to abut the first portion of the J-shaped cross-section to prevent the safety attachment member from passing through the central opening. The upper end of the spacer bar includes a series of holes aligned with holes in the lower end of the base member, whereby when safety attachment member is inserted onto the base member and secured thereto such as by welding or bolting, the safety attachment member extends outwardly of the lower end of the base member for a worker to attach safety gear thereto such as a safety lanyard. The first embodiment further includes a second part of the clamping mechanism comprised of materials similar or the same as the base member and includes a clamping member having a bottom surface adapted to overly the top surface of the spacer bar and a top surface. The clamping member having an upper end adapted to overly the upper end of the spacer bar and a lower end adapted to overly the lower end of the spacer bar. Although not intended to be a limitation of the shape and dimensions of the clamping member and base member, the widths of the upper ends of the clamping member and base member may be approximately equal, and the lower end of the clamping member may be approximately equal to the lower end of the base member. The upper end of the clamping member includes a centrally longitudinally extending slot therein disposed to be in alignment with the aligned holes in the upper end of the spacer bar and base member. The clamping member further includes a clamping extension extending from the lower end of the clamping member. The clamping extension extends across the entire width of the lower end of the clamping member and is formed by a first bend extending a first portion of the clamping extension at an obtuse angle of approximately 110 degrees with respect to the plane of the clamping member and a second bend extending a second portion of the clamping extension in an opposite direction to the first bend at an obtuse angle with respect to the plane of the first portion such that the second portion is approximately parallel with the plane of the clamping member thereby forming an S-shaped cross-section. The second bend of the clamping extension is spaced from the first bend a distance to surround a ladder rung or approximately 2-3 inches. The second portion of the clamping extension having a pair of laterally spaced apart tabs extending therefrom in the plane of the second portion. Each tab having a hole extending therethrough for receiving an attachment of a safety gear and/or tethered tool of a worker. The second portion of the J-shaped cross-section of the base member having a pair of laterally spaced holes therethrough disposed to be in alignment with the laterally spaced tabs of the clamping member such that as the clamping member is mounted to the base member, the rung of a ladder is captured between the J-shaped cross-section of the base member and the S-shaped cross-section of the clamping extension of the clamping member with the spaced tabs extending through the laterally spaced holes. The clamping member is secured to the base member either by bolts passing through the slot into holes of the spacer bar and into the threaded holes in the base member, or by nut and bolt fasteners passing through the slot from aligned holes in the base member and spacer bar. The clamping member may also be secured by through bolts or screws passing through the slot and clearance holes in the spacer bar and base member and into the roof itself.

In a second embodiment of the present invention, the base member and clamping members are similar to those of the first embodiment with the exception that the length X' of the upper end of the base member is somewhat shortened and may have fewer slots and holes. This embodiment also does not include a safety attachment member. Furthermore, the first portion of the J-shaped cross-section does not include a central opening. Instead, a flat elongated spacer bar is used having a lower end abutting against the first portion of the J-shaped cross-section. As in the first embodiment, the spacer bar includes a series of centrally located holes aligned with the holes in the lower end of the base member. Each tab having a hole extending therethrough to which a worker's safety equipment and/or a worker's tethered tool can be attached.

In a third embodiment of the present invention, the upper end of the base member is similar to the upper end of the base members of the second embodiments. In this embodiment, the upper end of the base member is somewhat shortened and includes a width and a length with at least one hole and/or side slot therein for receiving anchors such as 20 penny nails, lag bolts or ledger lock bolts that are driven or screwed through the asphalt shingles, slates or cedar shakes and into roofing substrate and roof rafter to secure the base member to the roof. This embodiment does not include a spacer bar or a separate safety attachment member as in the first or second embodiments. The lower end of the base member, first part of the clamping mechanism and safety attachment member and are formed as a one-piece structure. The clamping member is the same as in the first and second embodiments. The first part of the clamping mechanism is formed by two J-shaped cross-sections extending from opposite ends of the lower end of the base member. These J-shaped cross-sections are configured similar to the J-shaped cross-sections of the first and second embodiments. Each J-shaped cross-section includes first and second portions configured just as in the first and second embodiments. Each second portion of each J-shaped cross-section includes an opening disposed to be in alignment with the tabs of the clamping member for receiving the tabs of the clamping member when it is attached to the base member. In this third embodiment, the safety attachment member is disposed between the two J-shaped sections and is formed as an extension of the lower end of the base member and is bent out of the plane of the base member at an angle of approximately 30 degrees. The safety attachment member includes an opening therethrough for receiving a connecting device for a worker's safety equipment and/or a worker's tethered tool. The clamping member is secured directly to the base member in the same manner as disclosed in the first and second embodiments.

BRIEF DESCRIPTIONS OF THE DRAWINGS

FIG. 10 is a side view of the ladder bracket of the second embodiment of the present invention subsequent to the clamping member being secured to the base member.

The figures included herein are various views of the structures and installations of the first, second and third embodiments of the present invention. Although the figures depict exact dimensions of the preferred embodiments, such dimensions may be varied and therefore, not to be considered limiting.

DETAILED DESCRIPTION OF THE INVENTION

Figure 1:
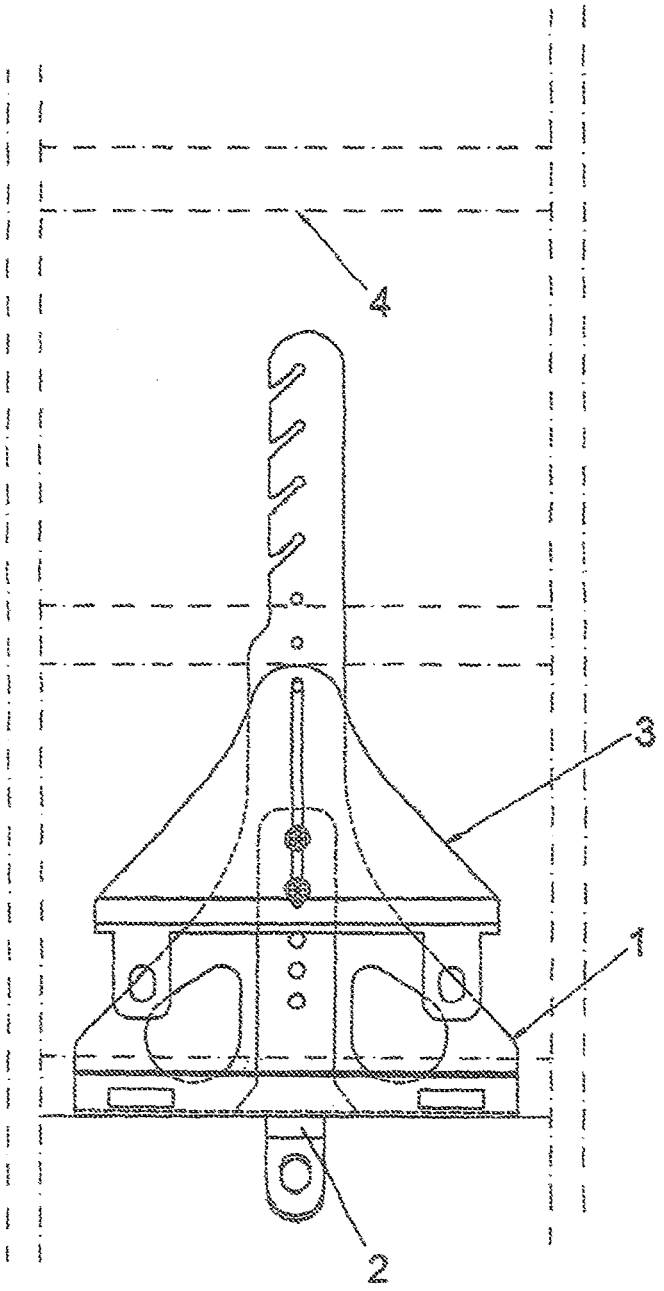
FIG. 1 is a pictorial view of a first embodiment of the ladder bracket of the present invention prior to the clamping member being secured to the base member.
Figure 2:
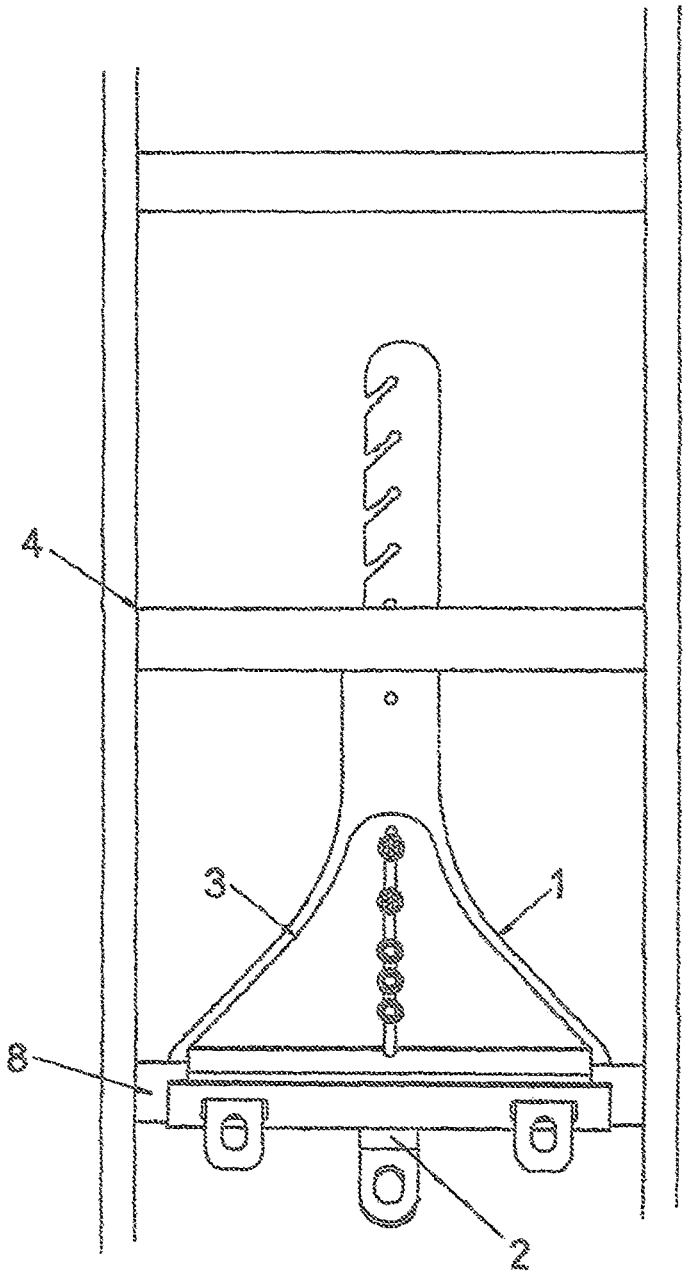
FIG. 2 is a pictorial view of a first embodiment of the ladder bracket of the present invention subsequent to the clamping member being secured to the base member.
Figure 3:
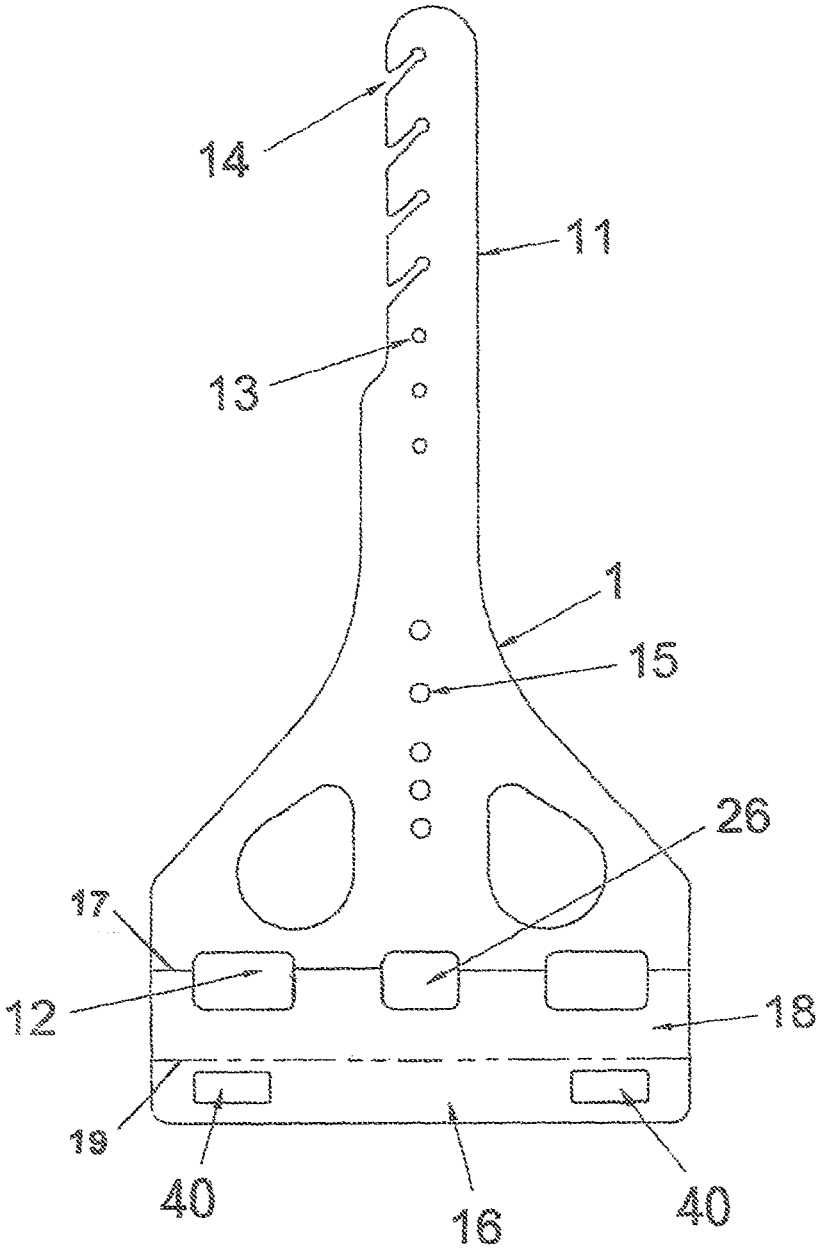
FIG. 3 is a plane view of the base member of the first embodiment prior to being configured as the first section of the clamping mechanism.

Referring to FIGS. 1 and 2, a first embodiment of the roofing ladder bracket of the present invention is illustrated. The bracket is made of multi-components each part made of a rigid and suitable material that meets the required strength to hold the ladder, a worker, and the impact load of a vertical fall of six feet by the worker as required to be OSHA compliant. Each component could be made from sheet metals such as mild steel, stainless steel, or aluminum preferably in the range of 10-12 gauge. The bracket could be made from moldable metals by injection or pour molding processes. Other moldable materials such as strong polymers or carbon fiber materials could also be employed from which the bracket is molded. The present invention is not to be limited by the materials selected in its manufacture as long as they meet OSHA requirements. The bracket as illustrated in FIGS. 1 and 2 includes a base member (1), a spacer bar (2) and a clamping member (3). As shown in FIG. 1, a ladder with rung (4) is mounted to the base member (1) prior to the clamping member (3) being slid into its clamping position as shown in FIG. 2. In the clamping position, the clamping member is secured to the base member by fasteners as will be described hereinafter. Once secured, the bracket provides a ladder rung clamping mechanism (8) for securing a ladder to the roof of a building and safety mechanism to which a worker's safety equipment can be attached.

As illustrated in FIGS. 1-4 and 7, the bracket of the present invention includes a flat base member (1) having a bottom surface (9) adapted to overly the roof and a top surface (10). The base member having an upper end (11) adapted to be mounted facing the ridge of the roof and a lower end (12) with a first part of the clamping mechanism (8) extending from the lower end of the base member and adapted to secure the rung (4) of a ladder therein. The upper end includes a width and a length with at least one hole (13) and/or side slot (14) therein for receiving anchors such as 20 penny nails, lag bolts or ledger lock bolts that are driven or screwed through the asphalt shingles, slates or cedar shakes and into roofing substrate and roof rafter to secure the base member to the roof. The upper end width may be approximately 2-4 inches. The upper end length X may be approximately 4-12 inches. However, these dimensions are preferred and not intended to be limiting and may vary. The lower end of the base member also includes a series of centrally located holes (15) therethrough that are either threaded or not threaded for receiving anchor bolts (not shown) therethrough from either the bottom surface or top surface of the base member as discussed hereinafter. The length of the lower end of the base member is approximately 6-10 inches and the width is approximately 10-12 inches. Thus, the overall length Y of the first embodiment of the present invention may be from 10-22 inches. Again, these dimensions are preferred and not intended to be limiting and may vary. The first part of the clamping mechanism (8) comprises an extension of the base member that is configured to have a J-shape cross-section to act as a hook in which the rung of a ladder is nested.

Figure 7:
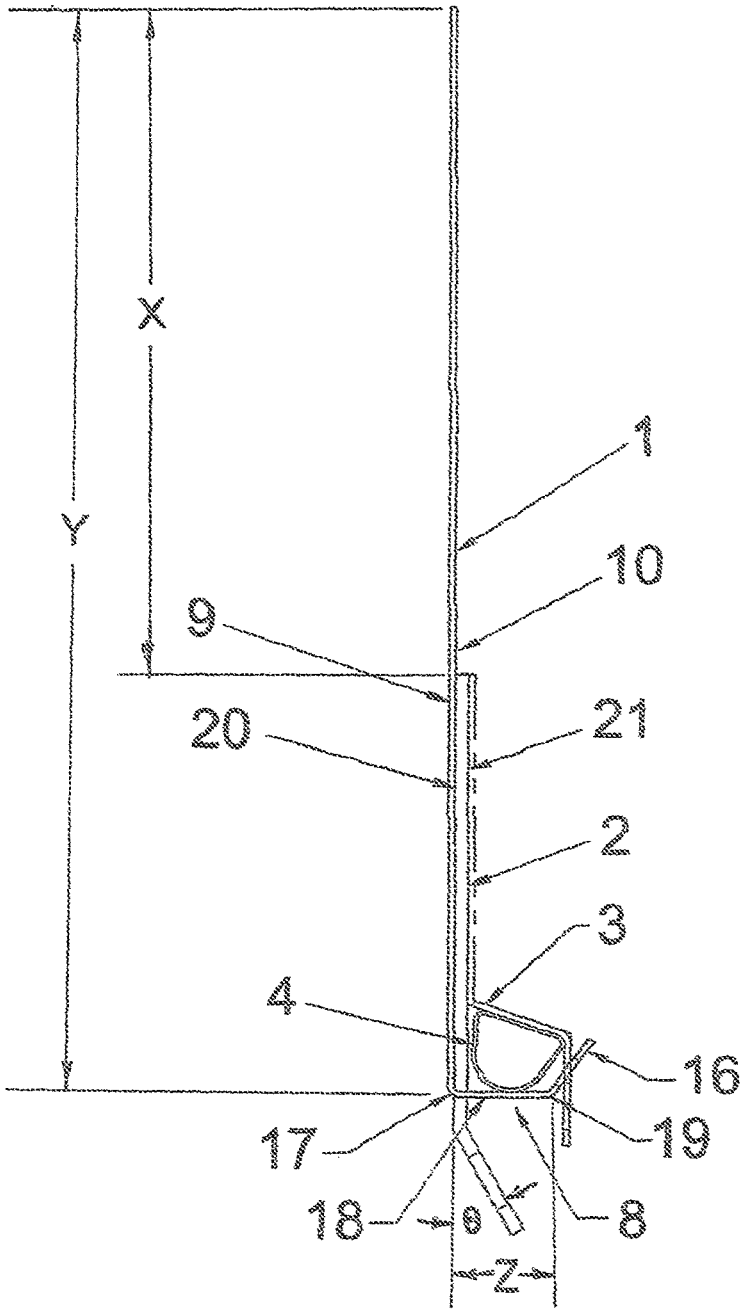
FIG. 7 is a side view of the ladder bracket of the first embodiment of the present invention subsequent to the clamping member being secured to the base member.
Figure 8:
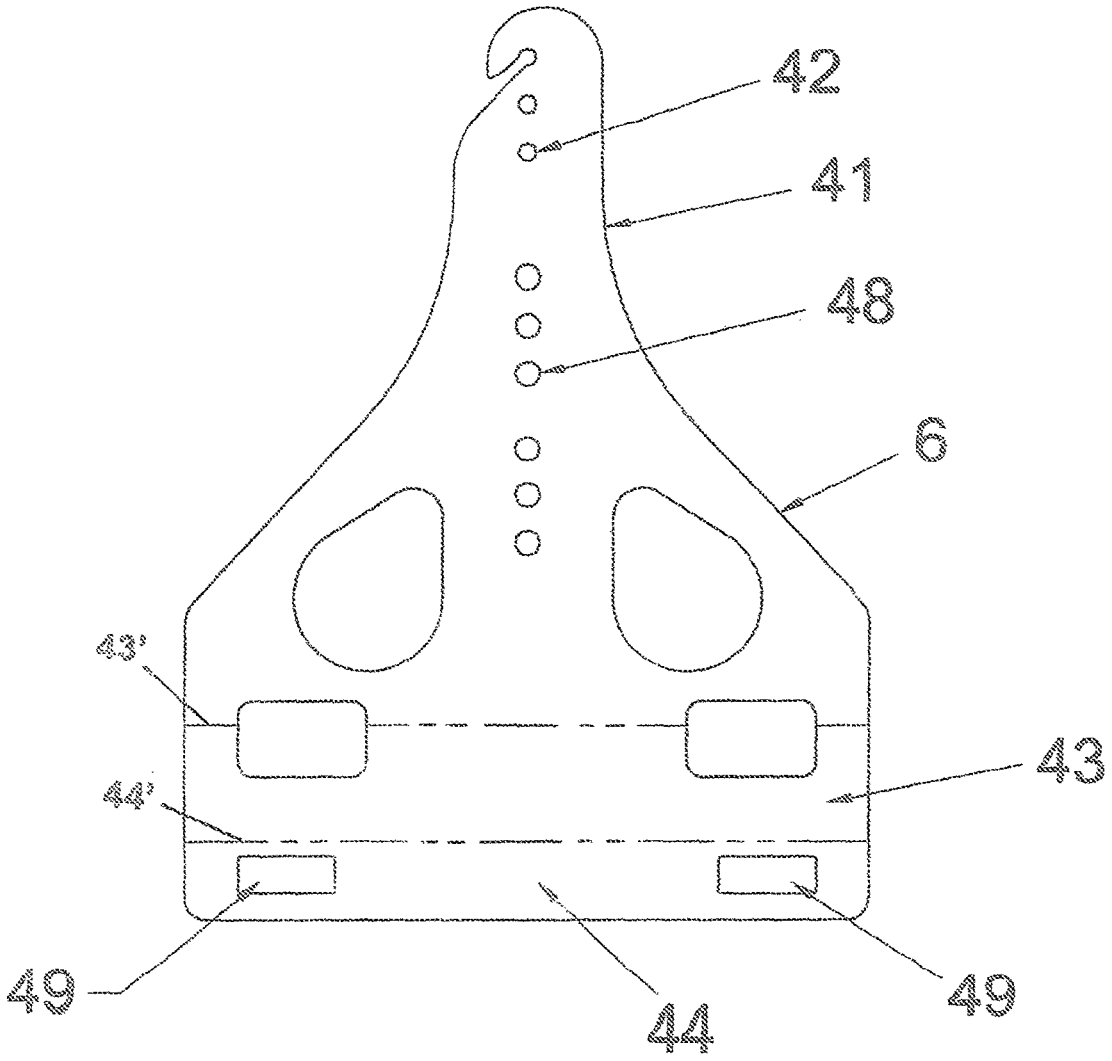
FIG. 8 is a plane view of the base member of a second embodiment of the present invention prior to being configured as the first section of the clamping mechanism.

In the first embodiment, the J-shaped cross-section of the first part of the clamping mechanism extends across the entire width of the lower end of the base member. The J-shaped cross-section is formed by a first bend (17) extending a first portion (18) of the base member extension approximately 90 degrees with respect to the plane of the remaining base member (1) and a second bend (19) extending a second portion (16) of the base member extension in the same direction as the first portion (18) and at an obtuse angle of approximately 55 degrees with respect to the plane of the first portion (18). The second bend of the base member extension is spaced from the first bend a distance Z approximately 2.0-3.0 inches to fit around a conventional ladder rung which is approximately 1.5-2.0 inches. The first embodiment also includes a flat elongated spacer bar (2) having a bottom surface (20) adapted to overly the top surface (10) of the base member and a top surface (21). The spacer bar includes an upper end (22) and a lower end (23). The lower end of the spacer bar is configured as a safety attachment member (24). The spacer bar member may have a width and length less than the width and length of the base member and is adapted to overly the base member along the central axis thereof. However, these dimensions are preferred and not intended to be limiting and may vary. The safety attachment member (24) may be angled upward at 24' from the plane of the flat spacer bar at an angle θ (FIG. 7) approximately 30 degrees and includes a hole (25) for receiving an attachment device such as a hook or carabineer tethered to a worker's safety equipment worn by the worker. The first portion (18) of the J-shaped cross-section includes a central opening (26) through which the safety attachment member (24) extends. The spacer bar (2) also includes stop elements (27) extending laterally from the lower end and adapted to abut the first portion (18) of the J-shaped cross-section as best illustrated in FIGS. 1 and 7 to prevent the safety attachment member from passing through the central opening. The upper end (22) of the spacer bar includes a series of holes (27') aligned with holes (15) in the lower end of the base member, whereby when the spacer bar (2) is mounted onto the base member with the safety attachment member (24) extending through hole (26), the spacer bar is secured to the base member such as by welding or bolting. The safety attachment member extends outwardly of the lower end of the base member for a worker to attach safety gear thereto such as a safety harness. The holes 27' are threaded to receive anchor bolts (not shown) as will be described hereinafter.

As illustrated in FIGS. 1-3, 5 and 6, the first embodiment further includes a second part of the clamping mechanism and includes a clamping member (3) comprised of materials similar or the same as the base member. The clamping member (3) includes a bottom surface (28) adapted to overly the top surface (21) of the spacer bar and a top surface (29). The clamping member having an upper end (30) adapted to overly the upper end (22) of the spacer bar and a lower end (31) adapted to overly the lower end (23) of the spacer bar. Although not intended to be a limitation of the shape and dimensions of the clamping member and base member, the widths of the upper ends of the clamping member and base member may be approximately equal, and the lower end of the clamping member may be approximately equal to the lower end of the base member. However, these dimensions are preferred and not intended to be limiting and may vary. The upper end of the clamping member includes a centrally longitudinally extending slot (32) therein disposed to be in alignment with the aligned holes (27) in the upper end of the spacer bar that are aligned with the holes (15) in the lower end of the base member. The clamping member (3) further includes a clamping extension (33) extending from the lower end (31) of the clamping member. The clamping extension may extend across the entire width of the lower end of the clamping member. However, this dimension is preferred and not intended to be limiting and may vary. The clamping extension is formed by a first bend (34) extending a first portion (36) of the clamping extension at an obtuse angle of approximately 110 degrees with respect to the plane of the upper end (30) of the clamping member and a second bend (35) extending a second portion (37) of the clamping extension in an opposite direction to the first portion (36) at an obtuse angle with respect to the plane of the first portion such that the second portion is approximately parallel with the plane of the upper end (30) of the clamping member thereby forming an S-shaped cross-section. The second bend of the clamping extension is spaced from the first bend a distance approximately 2.0-3.0 inches to fit around the diameter of a conventional ladder rung which is approximately 1.5-2.0 inches. The second portion (37) of the clamping extension having a pair of laterally spaced apart tabs (38) extending therefrom in the plane of the second portion. Each tab (38) includes a hole (39) extending therethrough for receiving an attachment device such as a hook or carabineer of a worker's safety equipment or a worker's tethered tool. The second portion (16) of the J-shaped section of the base member (1) includes a pair of laterally spaced holes (40) therethrough disposed to be in alignment with the laterally spaced tabs (38) of the clamping member.

As best illustrated in FIG. 7, when the clamping member (3) is mounted to the base member (1), the rung (4) of a ladder is captured between the J-shaped cross-section of the base member and the S-shaped cross-section of the clamping member with the spaced tabs (38) extending through the laterally spaced holes (40). The clamping member is then secured to the base member either by anchor bolts (not shown) passing through the slot (32) and threaded into threaded holes (27') of the spacer bar and into the threaded holes (15) in the base member, if threaded, or by bolt fasteners (not shown) passing from the bottom surface (9) of the base member through holes (15) in the base member and (27') in the spacer bar through the slot (32). Nuts (not shown) such as lock or wing nuts could be used to clamp the clamping member (3) to the base member (1) sandwiching the spacer bar (2) therebetween.

Figure 9:
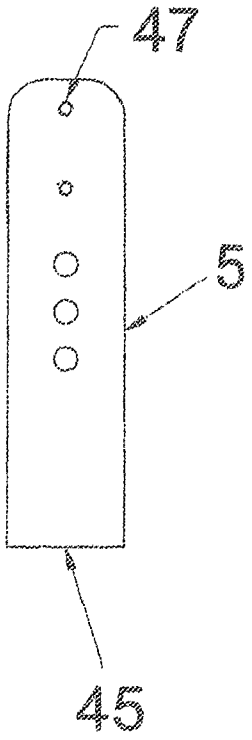
FIG. 9 is a plane view of the spacer bar of the second embodiment of the present invention.
Figure 4:
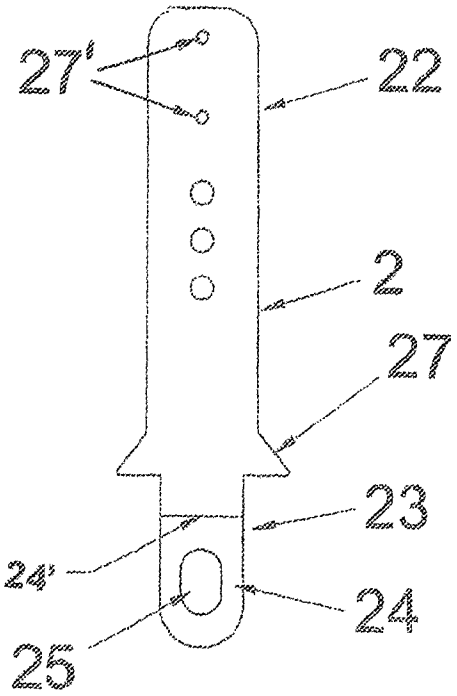
FIG. 4 is a plane view of the spacer bar with safety attachment member of the first embodiment of the present invention.
Figure 6:
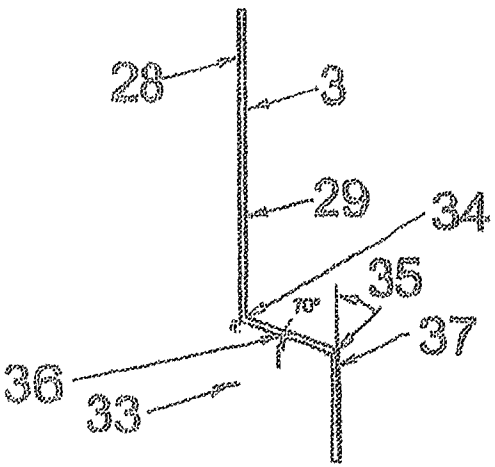
FIG. 6 is a side view of the clamping member of each embodiment of the present invention subsequent to being configured as the second section of the clamping mechanism.
Figure 5:
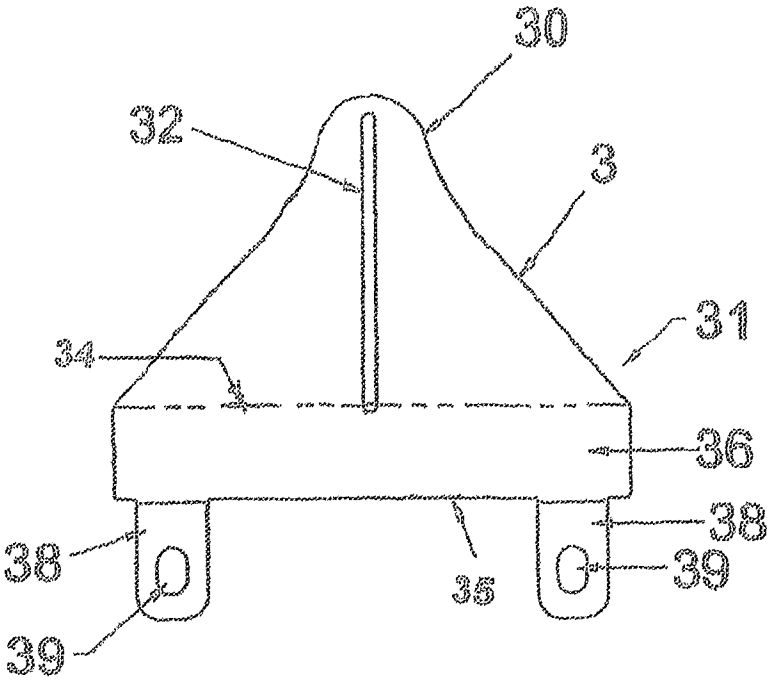
FIG. 5 is a plane view of the clamping member of each embodiment of the present invention prior to being configured as the second section of the clamping mechanism.

As illustrated in FIGS. 5, 6, 8, 9 and 10, a second embodiment of the present invention is disclosed. In this embodiment, the base member (6) and clamping member (3) are similar to those of the first embodiment with the exception that length X' of the upper end (41) of the base member (6) is approximately 4-6 inches and the overall length is approximately 12-14 inches. Furthermore, the distance Z' is the same as the distance Z in the first embodiment. The J-shaped cross-section is formed by a first bend (43') extending a first portion (43) of the base member extension approximately 90 degrees with respect to the plane of the remaining base member (6) and a second bend (44') extending a second portion (44) of the base member extension in the same direction as the first portion (43) and at an obtuse angle of approximately 55 degrees with respect to the plane of the first portion (43). Although these dimensions are preferred, they are not intended to be limiting and can vary. The upper end (41) includes only one side slot and at least one hole (42) for receiving anchors such as 20 penny nails, lag bolts or ledger lock bolts that are driven or screwed through the asphalt or slate shingle and into roofing substrate and roof rafter to secure the base member to the roof. This embodiment also does not include a safety attachment member as in the first embodiment. However, tabs (38) with holes (39) may serve as safety attachment members. Furthermore, the first portion (43) of the J-shaped cross-section extension (44) does not include a central opening as in the first embodiment. Instead, as shown in FIG. 9, a flat elongated spacer bar (5) is used having a lower end (45) abutting against the first portion (43) of the J-shaped cross-section extension (44). As in the first embodiment, the spacer bar includes a series of centrally located threaded holes (47) aligned with the holes (48) in the lower end of the base member (6). Holes (48) may or may not be threaded. Since the clamping member (3) for the first and second embodiments are identical, the same numerals are used for each embodiment. In this second embodiment, the holes (39) in tabs (38) are used to attach a worker's safety equipment or a worker's tethered tool to the bracket.

Figure 11:
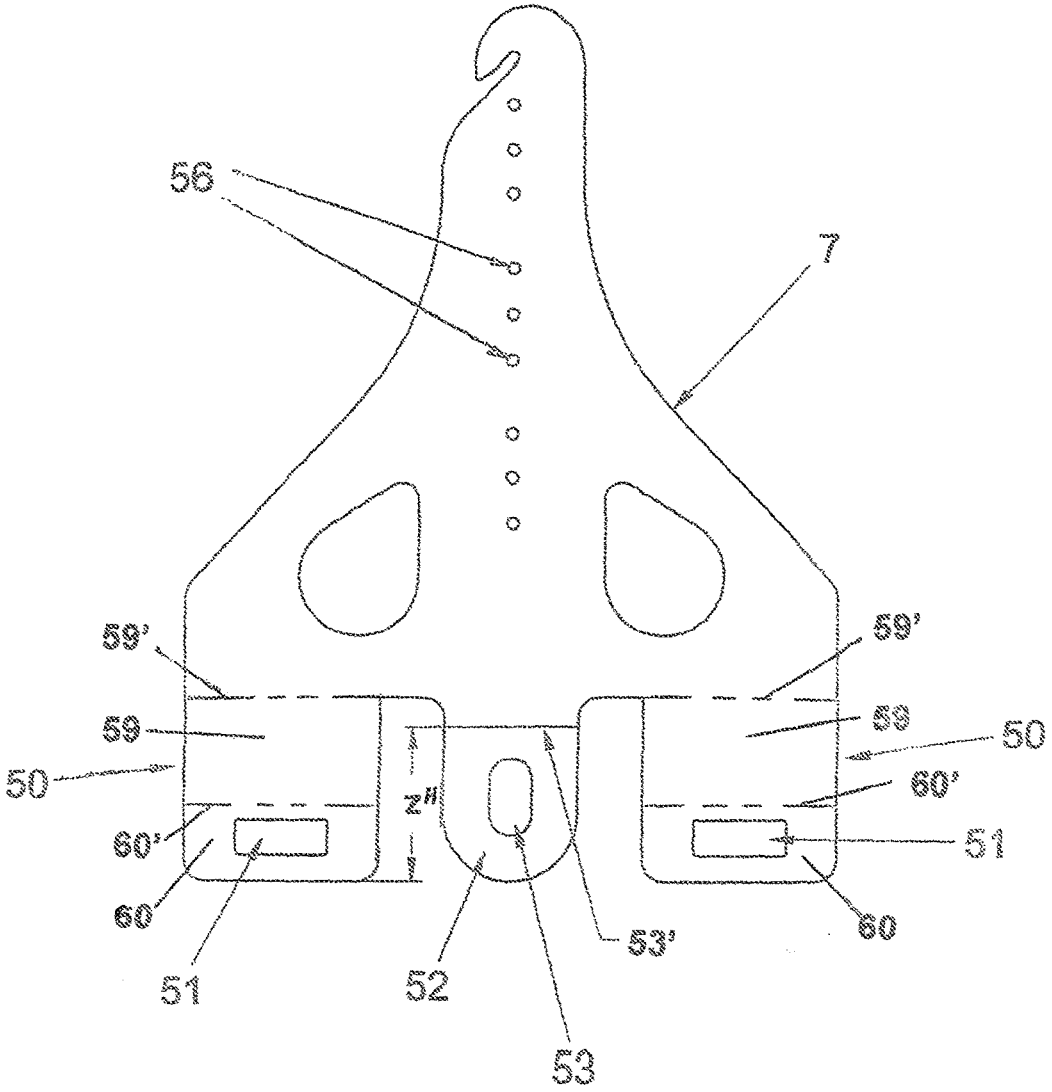
FIG. 11 is a plane view of the base member of a third embodiment of the present invention prior to being configured as the first section of the clamping mechanism.

As illustrated in FIG. 11, a third embodiment of the present invention is disclosed. This third embodiment includes only base member (7) and clamping member (3). The upper end of the base member (7) is somewhat shortened as in the second embodiment and includes a width and a length with at least one hole and/or one side slot therein for receiving anchors such as 20 penny nails, lag bolts or ledger lock bolts that are driven or screwed through the asphalt shingles, slates or cedar shakes and into roofing substrate and roof rafter to secure the base member to the roof. In this embodiment, the lower end of the base member (7), first part of the clamping mechanism (50) and safety attachment member (52) are integrally formed as a one-piece structure. The clamping member (3) is identical to the clamping members of the first and second embodiments. However, the first part of the clamping mechanism (50) is formed by two J-shaped cross-section extensions (50) extending from opposite ends of the lower end of the base member (7). These J-shaped cross-section extensions are configured similar to the J-shaped cross-section extensions of the first and second embodiments. Each J-shaped cross-section includes first and second portions bent at angles just as in the first and second embodiments. The J-shaped cross-section is formed by a first bend (59') extending a first portion (59) of the base member extension approximately 90 degrees with respect to the plane of the remaining base member (7) and a second bend (60') extending a second portion (60) of the base member extension in the same direction as the first portion (59) and at an obtuse angle of approximately 55 degrees with respect to the plane of the first portion (59). Each second portion of each J-shaped cross-section includes a hole (51) disposed to be in alignment with the tabs (38) of the clamping member (3) for receiving the tabs of the clamping member when it is attached to the base member. In this third embodiment, the safety attachment member (52) is disposed between the two J-shaped cross-sections (50) and is formed as an extension of the lower end of the base member (7) and is bent out of the plane of the base member at 53' at an angle of approximately 30 degrees. The bend is at a distance Z" of approximately 2.75 inches from the end thereof. The safety attachment member includes an opening (53) therethrough for receiving a connecting device such as a hook or carabineer for a worker's safety equipment or a worker's tethered tool. The clamping member (3) is secured directly to the base member (7) in the same manner as disclosed in the first and second embodiments. The centrally located holes (56) may be threaded to receive bolts (not shown) passing through slot (32) for clamping the clamping member (3) to base member (7), or by bolt fasteners (not shown) passing from the bottom surface of the base member (7) through holes (56) and through the slot (32). Nuts (not shown) such as lock or wing nuts could be used to clamp the clamping member (3) to the base member (7).

Figure 12:
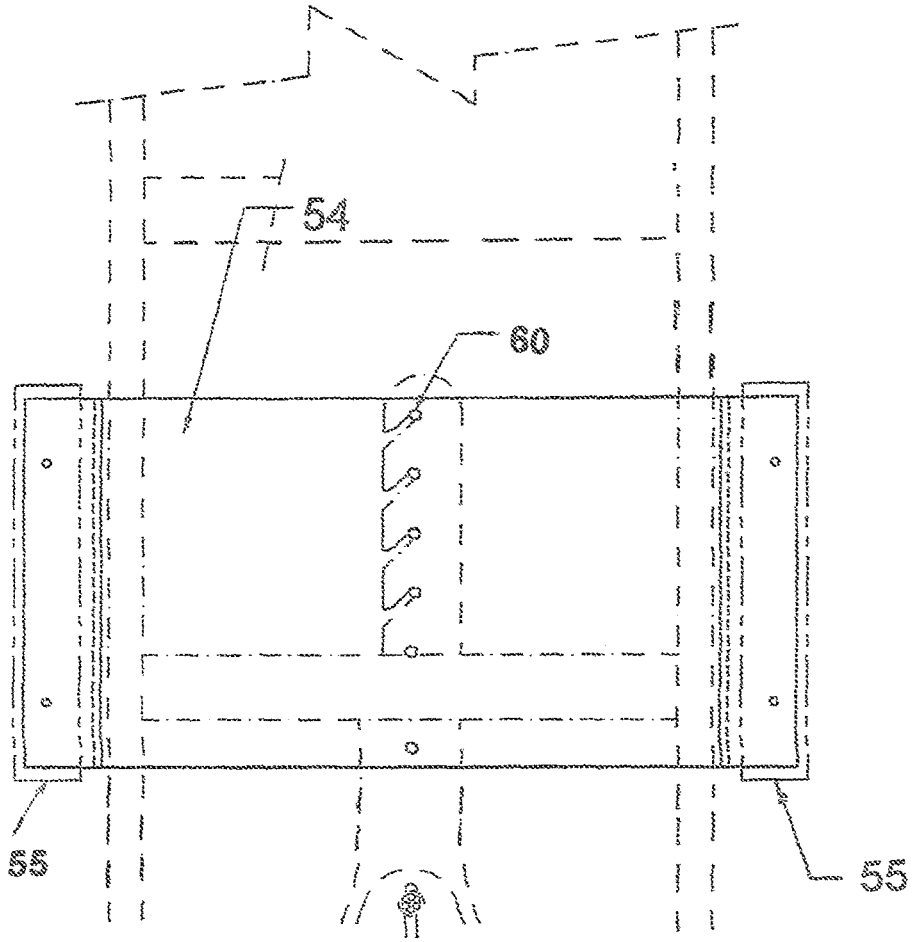
FIG. 12 is a top view of a converter bracket adapted to be clamped to a metal roof and which includes fasteners for securing thereto any of the first, second or third embodiments of the present invention.
Figure 13:
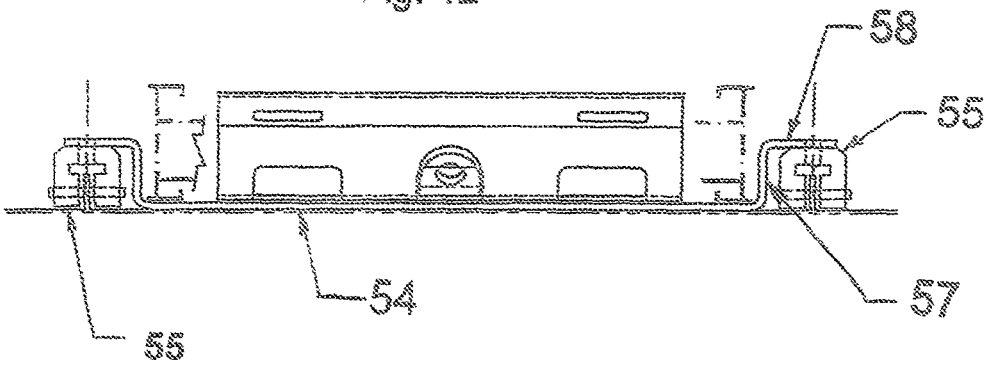
FIG. 13 is a side view of the converter bracket illustrated in FIG. 12.

Referring to FIGS. 12 and 13, a metal roof convertor bracket (54) is illustrated. The convertor bracket could be made from sheet metals such as mild steel, stainless steel or aluminum. The sheet metal preferably is in the range of 10-12 gauge. The convertor bracket could be made of moldable metals by injection molding or pour molding processes. Other moldable materials such as strong polymers or carbon fiber materials could be employed from which the bracket is molded. The convertor bracket is not to be limited by the materials selected in its manufacture as long as they meet OSHA requirements.

The converter bracket is designed to be mounted to a conventional metal roof having flat metal sections bound by vertically extending standing seams. The converter bracket includes a base plate for lying flat against the metal roof between the standing seams and may be approximately 12-16 inches in width. The length of the converter bracket may vary depending on which embodiment of the present invention is used and may be approximately 10-20 inches in length. The base plate further includes side flanges extending laterally therefrom. Each side flange includes a first segment (57) extending normally to the base plate and a second segment (58) extending laterally from the first segment. Each side flange preferably may extend the length of the base plate or may be comprised of several sections. Each first segment (57) having a height approximately equal to the height of a conventional metal roof standing seam anchor (55), such as those disclosed in U.S. Pat. Nos. D629,679 or 8,756,870, incorporated herein by reference. Each second segment (58) includes a series of holes for receiving lugs extending from each seam anchor (55) for securing the converter bracket against the metal roof. The base member of the converter bracket also includes a series of centrally located upstanding threaded studs 60 attached thereto such as by welding to which any of the slots or holes in the first, second or third embodiments can be mounted.

The present invention has been described supra in terms of various embodiments and as set forth in the detailed illustrations in the attached figures. It will be appreciated by those skilled in the art that various changes and modifications may be made to the embodiments without departing from the spirit or scope of the invention. It is not intended that the invention be limited to the embodiments shown and described. It is intended that the invention include all foreseeable modifications to the embodiments shown and described. It is intended that the invention be limited in scope only by the claims appended hereto.

We claim:

1. A roofing ladder bracket assembly comprising: a base member; a clamping member;

said clamping member slidably mounted with respect to said base member; at least one fastener adapted to fixedly secure said clamping member to said base member;

said base member having a flat upper end with at least one hole therethrough for receiving at least one fastener adapted to secure the base member to a roof, a lower end configured to extend around a lower portion of one rung of a roofing ladder and a flat mid-section between said upper end and lower end;

said clamping member having a flat upper end disposed in overlapping relation to said mid-section of said base member;

said clamping member having a lower end configured to extend around an upper portion of said one rung of a roofing ladder opposite to said lower portion;

said clamping member slidably mounted with respect to said base member from a first position where said lower end of the clamping member is spaced away from said lower end of said base member to a second position where said lower end of the clamping member is overlapping said lower end of said base member, whereby said one rung is surrounded by said lower end of said base member and said lower end of said clamping member;

whereby said bracket assembly is selectively located on a roof to secure a roofing ladder to a roof of a building with said one rung of the ladder captured between said lower end of said base member and the lower end of said clamping member.

2. A roofing ladder bracket assembly as claimed in claim 1 wherein lower end of said base member is wider than said upper end of said base member.

3. A roofing ladder bracket assembly as claimed in claim 2 wherein said width of said upper end of said base member is approximately 2-4 inches and said length of said upper end of said base member is approximately 4-12 inches; and said length of said lower end of the base member is approximately 6-10 inches and said width of said lower end is approximately 10-12 inches.

4. A roofing ladder bracket assembly as claimed in claim 2 wherein said lower end of said base member is configured to have a J-shape cross-section extending completely across said lower end of said base member for receiving a lower portion of a rung of a roofing ladder; and said lower end of said clamping member is configured to have an S-shape cross-section extending completely across said lower end of said clamping member for overlapping an upper portion of said one rung of a roofing ladder.

5. A roofing ladder bracket assembly as claimed in claim 4 and further comprising:

a flat spacer bar member fixedly disposed between said flat mid-section of said base member and said flat upper end of said clamping member thereby spacing said flat mid-section of said base member from said flat upper end of said clamping member;

said spacer bar member fixedly mounted to said based member; and said clamping member slidably mounted to said spacer bar member.

6. A roofing ladder bracket assembly as claimed in claim 5 wherein said J-shape cross-section is formed by the lower end of said base member having a first bend extending a first portion of said lower end approximately 90° with respect to said flat mid-section of said base member, and a second bend extending a second portion of said lower end of said base member in the same direction as said first portion approximately 145° with respect to said flat mid-section; and said S-shape cross-section is formed by a first bend extending a first portion of said lower end of said clamping member approximately 70° with respect to said flat upper end of said clamping member, and a second bend extending a second portion of said lower end of said clamping member in an opposite direction to said first portion approximately 70° with respect to said flat upper end of said clamping member whereby said second portion of said lower end is approximately parallel to said flat upper end of said clamping member.

7. A roofing ladder bracket assembly as claimed in claim 6 wherein the second portion of the lower end of said base member includes a pair of openings therethrough disposed, respectively, adjacent opposite ends of said lower end thereof, and said second portion of said clamping member includes a pair of tabs extending parallel thereto and aligned with said pair of openings in said lower end of said second portion of the lower end of said base member, whereby when said clamping member is slid into said second position, said tabs pass through said openings.

8. A roofing ladder bracket assembly as claimed in claim 7 wherein said tabs include holes therethrough for receiving an attachment of a safety gear and/or tethered tool of a worker.

9. A roofing ladder bracket assembly as claimed in claim 6 wherein said spacer bar member is fixedly mounted to said based member with a lower end abutting said first portion of said lower end of said base member.

10. A roofing ladder bracket assembly as claimed in claim 9 wherein said flat spacer bar member is fixedly attached to said mid-section of said base member by welding or bolts.

11. A roofing ladder bracket assembly as claimed in claim 6 wherein said first portion of said lower end of said base member includes a central opening therethrough, and said spacer bar member includes a safety attachment member extending from a lower end thereof, said safety attachment member extending through said central opening and includes a hole therethrough for receiving an attachment of a safety gear and/or tethered tool of a worker.

12. A roofing ladder bracket assembly as claimed in claim 11 wherein said safety attachment member extends at an angle of approximately 30° with respect to the flat spacer bar member.

13. A roofing ladder bracket assembly as claimed in claim 11 wherein said flat spacer bar member is fixedly attached to said mid-section of said base member by welding or bolts.

14. A roofing ladder bracket assembly as claimed in claim 11 wherein said flat spacer bar member includes laterally extending stops that abut said first portion of said lower end of said base member to prevent said spacer member from being pulled through said central opening in said first portion of said lower end of said base member.

15. A roofing ladder bracket assembly as claimed in claim 11 wherein said flat spacer member and said safety attachment member are formed as a one-piece structure.

16. A roofing ladder bracket assembly as claimed in claim 5 wherein said base member, clamping member and spacer member are made of sheet steel, sheet stainless steel, or sheet aluminum in the range of 10-12 gauge, or by moldable metals, or by moldable polymers or by carbon fiber materials.

17. A roofing ladder bracket assembly as claimed in claim 1 wherein upper end of said base member further includes at least one laterally extending open-ended slot angled toward said lower end for receiving fasteners adapted to secure the base member to a roof.

18. A roofing ladder bracket assembly as claimed in claim 2 wherein said lower end of said base member having at opposite ends thereof two spaced apart J-shaped cross-sections each adapted to receive a lower portion of a rung of a roofing ladder; and said lower end of said clamping member is configured as an S-shape cross-section for overlapping an upper portion of said one rung of a roofing ladder.

19. A roofing ladder bracket assembly as claimed in claim 18 wherein each of said J-shaped cross-sections are formed by the lower end of said base member having a first bend extending a first portion of said lower end approximately 90° with respect to said flat mid-section of said base member, and a second bend extending a second portion of said lower end of said base member in the same direction as said first portion approximately 145° with respect to said flat mid-section; and said S-shape cross-section is formed by a first bend extending a first portion of said lower end of said clamping member approximately 70° with respect to said flat upper end of said clamping member, and a second bend extending a second portion of said lower end of said clamping member in an opposite direction to said first portion approximately 70° with respect to said flat upper end of said clamping member whereby said second portion of said lower end is approximately parallel to said flat upper end of said clamping member.

20. A roofing ladder bracket assembly as claimed in claim 19 wherein the second portion of each of said J-shaped cross-sections includes a pair of openings therethrough, and said second portion of said clamping member includes a pair of tabs extending parallel thereto and aligned with said pair of openings in each second portion of said J-shaped cross-sections, whereby when said clamping member is slid into said second position, said tabs pass through said pair of openings.

21. A roofing ladder bracket assembly as claimed in claim 20 wherein said tabs include holes therethrough for receiving an attachment of a safety gear and/or tethered tool of a worker.

22. A roofing ladder bracket assembly as claimed in claim 18 wherein said lower end of said base member includes a safety attachment member extending therefrom between said opposing J-shaped cross-sections, said safety attachment member including a hole therethrough for receiving an attachment of a safety gear and/or tethered tool of a worker.

23. A roofing ladder bracket assembly as claimed in claim 22 wherein said safety attachment member extends at an angle of approximately 30° with respect to the flat mid-section of said base member.

24. A roofing ladder bracket assembly as claimed in claim 22 wherein said base member and said safety attachment member are formed as a one-piece structure.

25. A roofing ladder bracket assembly as claimed in claim 24 wherein said base member and clamping member are made of sheet steel, sheet stainless steel, or sheet aluminum in the range of 10-12 gauge, or by moldable metals, or by moldable polymers or by carbon fiber materials.

26. A roofing ladder bracket assembly as claimed in claim 3 in combination with a converter bracket for mounting said roofing ladder bracket assembly to a metal roof having flat metal sections bound by vertically extending standing seams, said converter bracket including a flat base plate having top and bottom edges and opposite side portions, said flat base plate having a width greater than the width of said lower end of said lower end of said base member of said roofing ladder bracket assembly and a length approximately equal to or less than the overall length of said base member of said roofing ladder bracket assembly, each of said side portions configured to have at least one laterally extending flange spaced from said flat base plate a predetermined distance, each said laterally extending flange having at least one hole for receiving a threaded lug of a metal roof standing seam anchor having a predetermined height, said predetermined distance being approximately equal to the predetermined height of said metal roof standing seam anchor, said flat base plate having at least one threaded lug extending normally thereto along a central axis thereof, whereby said metal roof standing seam anchors are mountable on said metal roof standing seams and each of said flanges of said converter bracket are mountable to said threaded lugs of said metal roof standing seam anchors and said at least one hole in said base member of said roofing ladder bracket assembly is mountable to said at least one threaded lug of said converter bracket.

27. A roofing ladder bracket assembly as claimed in claim 26, wherein said converter bracket is made of sheet steel, sheet stainless steel, or sheet aluminum in the range of 10-12 gauge, or by moldable metals, or by moldable polymers or by carbon fiber materials.

28. A converter bracket for mounting a roofing ladder bracket assembly having an overall length approximately 12-22 inches and said width approximately 10-12 inches to a metal roof having flat metal sections bound by vertically extending standing seams, said converter bracket including a flat base plate having top and bottom edges and opposite side portions, said flat base plate having a width greater than the width of said roofing ladder bracket assembly and a length approximately equal to or less than the overall length of said roofing ladder bracket assembly, each of said side portions configured to have at least one laterally extending flange spaced from said flat base plate a predetermined distance, each said laterally extending flange having at least one hole for receiving a threaded lug of a metal roof standing seam anchor having a predetermined height, said predetermined distance being approximately equal to the predetermined height of said metal roof standing seam anchor, said flat base plate having at least one threaded lug extending normally thereto along a central axis thereof, whereby said metal roof standing seam anchors are mountable on said metal roof standing seams and each of said flanges of said converter bracket are mountable to said threaded lugs of said metal roof standing seam anchors and said roofing ladder bracket assembly is mountable to said at least one threaded lug of said converter bracket.

* * * * *